US005243802A

United States Patent [19]

Zetena, Jr.

[11] Patent Number: 5,243,802

[45] Date of Patent: Sep. 14, 1993

[54] WALLBOARD ADAPTOR BRACKET

[76] Inventor: Maurice F. Zetena, Jr., Christian St., Bridgewater, Conn. 06752

[21] Appl. No.: 643,450

[22] Filed: Jan. 18, 1991

[51] Int. Cl.[5] ..... E02D 37/00

[52] U.S. Cl. ..... 52/514; 411/970

[58] Field of Search ..... 52/514; 411/970, 999, 411/533

[56] References Cited

U.S. PATENT DOCUMENTS

| | | | |
|---|---|---|---|
| 3,331,273 | 7/1967 | Derby | 411/970 X |
| 3,426,817 | 3/1967 | Parkin et al. | 411/970 X |
| 3,461,937 | 8/1969 | Finney | 411/970 X |
| 3,496,980 | 2/1970 | Steward et al. | 411/970 X |
| 4,306,708 | 12/1981 | Gassaway et al. | 411/999 X |
| 4,370,842 | 2/1983 | Martin et al. | 52/514 |
| 4,408,429 | 10/1983 | Neal | 52/514 |
| 4,588,172 | 5/1986 | Fourrey et al. | 74/60 X |
| 4,714,507 | 12/1987 | Ohgushi | 52/514 X |
| 4,930,281 | 6/1990 | Martin et al. | 52/514 |

*Primary Examiner*—Carl D. Friedman
*Assistant Examiner*—Kien Nguyen
*Attorney, Agent, or Firm*—Haynes N. Johnson

[57] ABSTRACT

A wallboard adaptor bracket formed of sheet metal defining a plate with a central opening therein, holes in the bracket for receiving retaining screws, the holes having been formed by coining the material to form an opening and to form a collar around the opening on one surface of the sheet metal. The retaining screw holes and collar are so dimensioned as to hold the retaining screws perpendicular to the bracket.

9 Claims, 1 Drawing Sheet

WALLBOARD ADAPTOR BRACKET

FIELD OF THE INVENTION

This invention relates to wallboard adaptor brackets, that is, brackets which are fitted to openings in wallboard to receive and hold wall plates.

BACKGROUND OF THE INVENTION

Wallboard adaptor brackets have long been used to grip wallboard around openings so that wall plates or other devices can be secured to the wall. One type is simply a rear bracket which is secured to the wall plate by screws going through the wallboard. Another, shown in FIG. 1, is a rectangular bracket with an opening in it which is held to the wallboard by retaining pawls secured to the bracket by screws and pressing against the inner surface of the wallboard. This is relatively expensive to manufacture because it requires that a keeper be formed in the bracket to hold the retaining screws perpendicular to the bracket. My invention eliminates the need for this keeper.

BRIEF SUMMARY OF THE INVENTION

My wallboard adaptor plate is similar to those of the prior art except the keeper has been eliminated. Instead of countersinking holes for the retaining screws, the holes are coined to provide an exact fit for the screw and screw head and an inwardly extending, unthreaded collar which together hold the retaining screw perpendicular to the wallboard adaptor bracket while the retaining pawls are tightened against the inner surface of the wallboard.

DETAILED DESCRIPTION OF THE INVENTION

Figure 1:
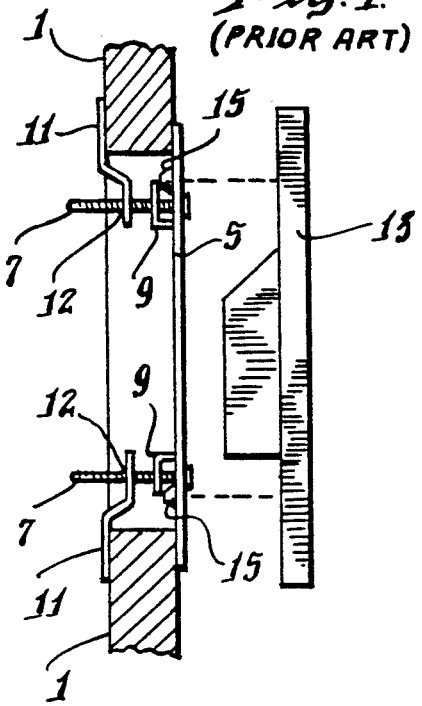
Fig. 1. (PRIOR ART)
FIG. 1 is a vertical section through a wall and bracket, taken close to the near edge of the bracket, showing a prior art adaptor bracket secured to wallboard by retaining pawls.

FIG. 1, showing a prior art structure, depicts wallboard 1 with an opening 3 in it. Adaptor bracket 5 has been mounted over the opening and is held in place by screws 7 passing through countersunk holes in bracket 5 and then threaded through holes 12 in retaining pawls 11 so that pawls 11 press against the back of the wallboard and hold the bracket in place.

Keepers 9 have been formed on bracket 5, bent inwardly and then over the path of travel of the screws 7. Keepers 9 have unthreaded holes in them, through which the retaining screws pass, and thus hold the retaining screws perpendicular to bracket 5, as is desired. Though keepers have been needed in the past, the cost of punching and bending the keepers of the prior art bracket is relatively high.

Once adaptor bracket 5 has been installed, a wall plate 13 is screwed to it, the screws passing along the dotted lines shown and through countersunk holes 15. The wall plate may be of any desired kind, such as the recessed plate shown in my U.S. Pat. No. 4,558,172.

FIGS. 2 to 5 and 7 disclose the adaptor bracket of my invention; and the numbers used are the same for comparable parts, except the new bracket itself is now 21.

Figure 2:
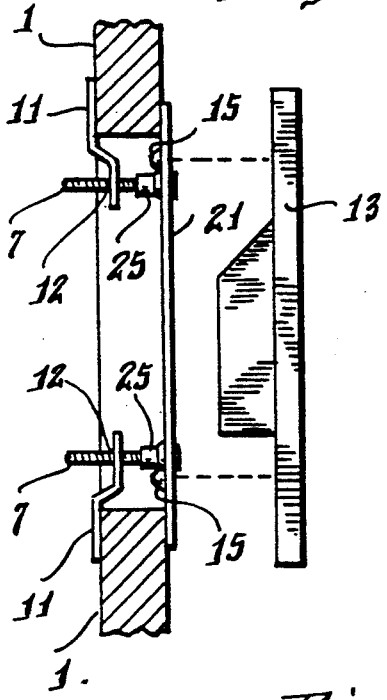
FIG. 2 is a similar view showing the adaptor bracket of my invention.
Figure 3:
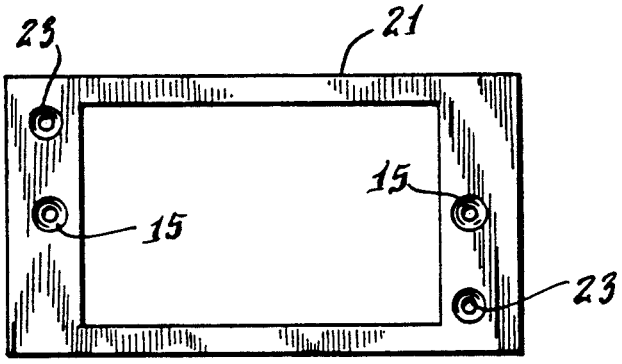
FIG. 3 is a front plan view of my adaptor bracket.
Figure 5:
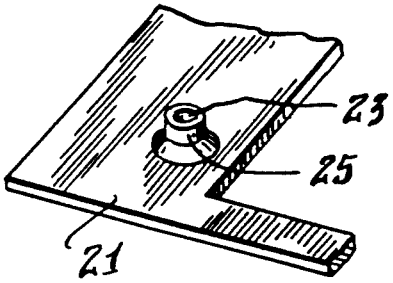
FIG. 5 is a partial perspective rear view of a corner of my adaptor bracket showing the collar which has been formed, by coining, about the hole for the retaining screw.
Figure 6:
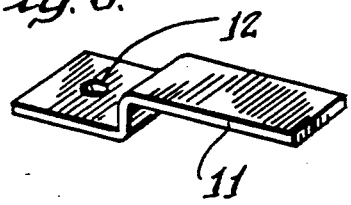
FIG. 6 is a perspective view of the retaining pawl 11.
Figure 4:
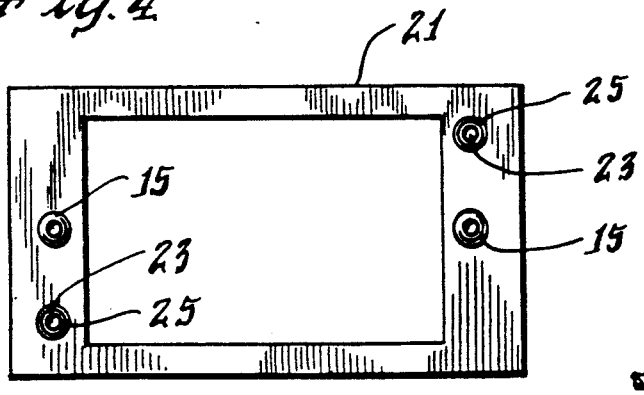
FIG. 4 is a rear plan view of my adaptor bracket.
Figure 7:
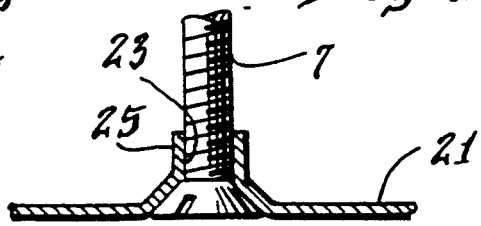
FIG. 7 is a transverse section through the screw and collar of my invention.

My new bracket is similar to that of the prior art but does not have keepers 9. Instead, the holes 23 through bracket 21 for the screws 7 have been formed by coining the material. The coining operation is done with a tool of a size which exactly fits the beveled head of the flat head screw and which forms an inwardly-facing collar 25 on the rear surface of adaptor bracket 21 about the hole 23. The axis of the collars is perpendicular to the surface of the adaptor bracket. The inner diameter of the collars is unthreaded and provides a close tolerance hole to the outer diameter of the threaded part of screws 7. As a result the screw holes 23 and collars 25 serve to hold the retaining screws perpendicular to the bracket and obviate the need for the keepers 9. This can be seen in FIG. 7. Retaining screws 7 are again threaded through holes 12 in pawls 11, as shown in FIG. 2.

By way of example, adaptor bracket 21 can be made of 0.060 inch steel sheet and be held in place with #6 flat head screws. The recess coined for the head of the screw would have an angle of 82° to match the same angle of the screw head. The collar would have a hole with an inner diameter of 0.140 inches to correspond to the 0.138 inch outer diameter of the screw. The depth "D" of the hole from the outer surface of the bracket to the inner end of the collar is 0.279 inches. Tolerances such as these are what I mean by a "close tolerance."

As a result of using the close tolerance coined hole and collar structure, the retaining screws are held substantially perpendicular to the surface of bracket 21, and a keeper is not required.

I claim:

1. A wallboard adaptor bracket formed of sheet metal defining a plate with a central opening therein, at least one threaded hole for receiving wall plate screws, at least one hole for receiving a retaining screw, said hole for receiving a retaining screw having been formed by coining said sheet metal to form an opening therein and to form a collar around said hole for receiving a retaining screw on one surface of said sheet metal, said collar being integral with said plate along the periphery of said collar.

2. A wallboard adaptor bracket as set forth in claim 1 including a pair of said holes for receiving retaining screws and a pair of said collars.

3. A wallboard adaptor bracket as set forth in claim 1 in which said hole for retaining screw and said collar have close tolerances relative to the retaining screw to be used, whereby such retaining screw will be held by said hole and said collar perpendicular to said bracket.

4. A wallboard adaptor bracket formed of sheet metal, flat retaining screws and associated pawls to secure said bracket to wallboard, a pair of holes in said sheet metal for receiving said retaining screws, a collar around each said hole on one surface of said bracket, each said collar being formed from said sheet metal and being integral with said sheet metal along the periphery of said collar, and each said collar and hole being dimensioned to hold a said retaining screw perpendicular to said sheet metal.

5. A wallboard adaptor bracket as set forth in claim 4 in which said collars and holes are of close tolerance relative to said retaining screws.

6. A wallboard adaptor bracket as set forth in claim 4 in which said retaining screws are flat head screws with a threaded shaft and a head being beveled at an angle towards said shaft and in which said hole and said collar have an inner dimension and angle corresponding to said head and said shaft of said retaining screw.

7. A wallboard adaptor bracket as set forth in claim 6 including a threaded pawl associated with each said retaining screw.

8. A wallboard adaptor bracket formed of a plate with a central opening therein, at least one threaded hole for receiving wall plate screws, at least one unthreaded retaining screw hole for receiving a retaining screw, said retaining screw hole being recessed on one side of said plate, an unthreaded collar about said retaining screw hole on the opposite side of said plate from said recess, said collar being integral with said plate along the periphery of said collar, and said collar being perpendicular to said plate.

9. A wallboard adaptor bracket as set forth in claim 8 in which said recess and said collar have close tolerances relative to the retaining screw being used.

* * * * *